US007941899B2

(12) United States Patent
Saeger et al.

(10) Patent No.: US 7,941,899 B2
(45) Date of Patent: May 17, 2011

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventors: Nicole Saeger, Aachen (DE); Johannes Bossmann, Mönchengladbach (DE); Thomas Schmitz, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 384 days.

(21) Appl. No.: 12/163,419

(22) Filed: Jun. 27, 2008

(65) Prior Publication Data

US 2009/0000070 A1 Jan. 1, 2009

(30) Foreign Application Priority Data

Jun. 29, 2007 (DE) ..... 10 2007 030 471
Jun. 29, 2007 (DE) ..... 20 2007 010 686 U
Nov. 9, 2007 (DE) ..... 10 2007 053 895

(51) Int. Cl.
*D01G 19/00* (2006.01)

(52) U.S. Cl. ..... 19/217

(58) Field of Classification Search ..... 19/115 R, 19/228, 215, 216, 217
See application file for complete search history.

(56) References Cited

U.S. PATENT DOCUMENTS 1,408,780 A * 3/1922 Schleifer ..... 19/217
1,425,059 A * 8/1922 Schleifer ..... 19/217
1,694,432 A * 12/1928 Schleifer ..... 19/217
1,708,032 A * 4/1929 Schleifer ..... 19/217
1,715,473 A * 6/1929 Schleifer ..... 19/217
1,799,066 A * 3/1931 Schleifer ..... 19/217
2,044,460 A * 6/1936 Bartram et al. ..... 19/99
2,962,772 A 12/1960 Draving et al.
3,108,333 A * 10/1963 Schleifer ..... 19/235
4,270,245 A 6/1981 Stewart et al.
5,007,623 A 4/1991 Unkuri et al.
5,343,686 A 9/1994 Buchner et al.
5,404,619 A 4/1995 Jorg
5,457,851 A 10/1995 Mondini (Continued)

FOREIGN PATENT DOCUMENTS

DE 367482 C 1/1923

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner* — Shaun R Hurley
(74) *Attorney, Agent, or Firm* — Venable LLP; Robert Kinberg; Steven J. Schwarz

(57) ABSTRACT

In an apparatus for the fiber-sorting or fiber-selection of fiber material which is supplied by means of supply means to a fiber-sorting device, at least one mechanical device is present which generate a combing action to remove non-clamped constituents such as short fibers. To enable productivity to be substantially increased in a simple manner and an improved combed sliver to be obtained, downstream of the supply device there are arranged at least first and second rotatably mounted rollers with clamping devices for the fiber bundles, and the apparatus further comprises at least two supply devices and/or at least one further high-speed roller and/or at least two take-off devices.

18 Claims, 12 Drawing Sheets

U.S. PATENT DOCUMENTS

| | | | | |
|---|---|---|---|---|
| 5,502,875 | A | 4/1996 | Stolz et al. | |
| 5,796,220 | A | 8/1998 | Clapp et al. | |
| 6,163,931 | A | 12/2000 | Leifeld | |
| 6,173,478 | B1 | 1/2001 | Patelli et al. | |
| 6,216,318 | B1 | 4/2001 | Leifeld | |
| 6,235,999 | B1 | 5/2001 | Rubenach | |
| 6,295,699 | B1 | 10/2001 | Temburg | |
| 6,499,194 | B1 | 12/2002 | Gresser et al. | |
| 6,611,994 | B2 | 9/2003 | Gresser et al. | |
| 7,173,207 | B2 | 2/2007 | Losbrock et al. | |
| 2002/0124354 | A1 | 9/2002 | Pferdmenges et al. | |
| 2003/0005551 | A1 | 1/2003 | Schurenkramer et al. | |
| 2003/0029003 | A1 | 2/2003 | Breuer et al. | |
| 2003/0070260 | A1 | 4/2003 | Rubenach | |
| 2003/0154572 | A1 | 8/2003 | Pferdmenges et al. | |
| 2004/0040121 | A1 | 3/2004 | Schmitz | |
| 2004/0128799 | A1 | 7/2004 | Hosel et al. | |
| 2005/0076476 | A1 | 4/2005 | Temburg | |
| 2005/0198783 | A1 | 9/2005 | Rubenach | |
| 2005/0278900 | A1 | 12/2005 | Dammig | |
| 2006/0260100 | A1 | 11/2006 | Duda et al. | |
| 2007/0180658 | A1 | 8/2007 | Saeger et al. | |
| 2007/0180659 | A1 | 8/2007 | Saeger et al. | |
| 2007/0180660 | A1 | 8/2007 | Saeger et al. | |
| 2007/0266528 | A1 | 11/2007 | Farber et al. | |
| 2008/0092339 | A1 | 4/2008 | Bossman et al. | |
| 2009/0000064 | A1* | 1/2009 | Saeger et al. | 19/105 |
| 2009/0000065 | A1* | 1/2009 | Saeger et al. | 19/115 R |
| 2009/0000066 | A1* | 1/2009 | Saeger et al. | 19/115 R |
| 2009/0000067 | A1* | 1/2009 | Leder et al. | 19/115 R |
| 2009/0000068 | A1* | 1/2009 | Saeger et al. | 19/115 R |
| 2009/0000069 | A1* | 1/2009 | Saeger et al. | 19/115 R |
| 2009/0000071 | A1* | 1/2009 | Saeger et al. | 19/115 R |
| 2009/0000072 | A1* | 1/2009 | Saeger et al. | 19/115 R |
| 2009/0000073 | A1* | 1/2009 | Saeger et al. | 19/115 R |
| 2009/0000074 | A1* | 1/2009 | Bossmann | 19/115 R |
| 2009/0000075 | A1* | 1/2009 | Saeger et al. | 19/115 R |
| 2009/0000076 | A1* | 1/2009 | Bossmann et al. | 19/128 |
| 2009/0000077 | A1* | 1/2009 | Saeger et al. | 19/233 |
| 2009/0000078 | A1* | 1/2009 | Saeger et al. | 19/233 |
| 2009/0000079 | A1* | 1/2009 | Bossmann | 19/80 A |

FOREIGN PATENT DOCUMENTS

| | | | |
|---|---|---|---|
| DE | 382169 | C | 9/1923 |
| DE | 399885 | C | 7/1924 |
| DE | 489 420 | C | 1/1930 |
| DE | 30 48 501 | A1 | 7/1982 |
| DE | 103 20 452 | A1 | 11/2004 |
| EP | 1 586 682 | | 10/2005 |
| WO | WO-2006/012758 | A1 | 2/2006 |

OTHER PUBLICATIONS

German Patent Office Search Report, dated Oct. 20, 2006, Issued related German Patent Application No. 10 2006 050 453.4, and partial English-language translation.

U.S. Office Action dated Feb. 26, 2010, issued in related U.S. Appl. No. 12/149,506.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

This application claims priority from German Utility Model Application No. 20 2007 010 686.6 dated Jun. 29, 2007 and German Patent Application NO. 10 2007 053 895.4 dated Nov. 9, 2007, the entire disclosure of each of which is incorporated herein by reference.

BACKGROUND OF THE INVENTION

The invention relates to an apparatus for the fibre-sorting or selection of a fibre bundle comprising textile fibres, especially for combing. In certain known apparatus, fibre sliver is supplied by means of supply means to a fibre-sorting device, especially to a combing device, in which clamping devices are provided, which clamp the fibre bundle at a distance from its free end and mechanical means are present, which generate a combing action from the clamping site to the free end of the fibre bundle in order to loosen and remove non-clamped constituents, such as, for example, short fibres, neps, dust and the like from the free end, wherein at least one take-off means is present for removal of the combed fibre material.

In practice, combing machines are used to free cotton fibres or woolen fibres of natural impurities contained therein and to parallelise the fibres of the fibre sliver. For that purpose, a previously prepared fibre sliver is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre bundle supplied by the nipper assembly, a top comb and a fixed-position detaching device for detaching the combed-out fibre bundle from the nipper assembly. The lap ribbon supplied to the nipper assembly is here fed via a feed cylinder to a detaching roller pair. The fibre bundle protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre bundle is additionally pulled by the needles of a top comb. The top comb combs out the rear part of the detached fibre bundle and also holds back neps, impurities and the like. The top comb, for which in structural terms space is required between the movable nipper assembly and the movable detaching roller, has to be constantly cleaned by having air blown through it. For piercing into and removal from the fibre sliver, the top comb has to be driven. Finally, the cleaning effect at this site of jerky movement is not ideal. Owing to the differences in speed between the lap ribbon and the detaching speed of the detaching rollers, the detached fibre bundle is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre bundle protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is the aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

at least one fibre sorting device in which clamping devices are provided which each clamp a bundle of the textile fibres at a distance from its free end;

at least one supply device for supplying the fibre bundle to the fibre-sorting device;

at least one take-off device for removing the sorted fibre material from the fibre-sorting device; and at least one mechanical device for generating a combing action from the clamping site to the free end of the fibre bundle in order to loosen and remove non-clamped constituents; wherein the at least one fibre-sorting device has first and second rotatably mounted high-speed rollers that, in use, rotate rapidly without interruption, the clamping devices being distributed spaced apart in the region of the periphery of at least one said roller, and the apparatus further comprises at least two supply devices and/or at least one further high-speed roller and/or at least two take-off devices.

By implementing the functions of clamping and moving the fibre bundles to be combed-out on at least two rotating rollers, preferably at least one turning rotor and at least one combing rotor, high operating speeds (nip rates) are achievable—unlike the known apparatus—without large mass accelerations and reversing movements. In particular, the mode of operation is continuous. When high-speed rollers are used, a very substantial increase in hourly production rate (productivity) is achieved which had previously not been considered possible in technical circles. A further advantage is that the rotary rotational movement of the rollers with the plurality of clamping devices leads to an unusually rapid supply of a plurality of fibre bundles per unit of time to the first roller and to the second roller. In particular the high rotational speed of the rollers allows production to be substantially increased. To form the fibre bundle, the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out. The fibre bundles are—unlike the known apparatus—held by a plurality of clamping devices and transported under rotation. The clamping point at the particular clamping devices therefore remains substantially constant on each roller until the fibre bundles are transferred to the subsequent roller or take off roller. A relative movement between clamping device and fibre bundle does not begin until after the fibre bundle has been gripped by the first or second roller, respectively, and in addition clamping has been terminated. Because a plurality of clamping devices is available for the fibre bundles, in an especially advantageous manner fibre bundles can be supplied to the first or second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is the same. The clamping elements close and open during the movement in the direction of the transported fibre material. The at least one second roller (combing rotor) is arranged downstream of the at least one first roller (turning rotor). A substantially increased productivity is achieved with the apparatus according to the invention. A further particular advantage is that a process-adapted design of the individual elements and assemblies and the combination thereof is made possible.

In certain preferred embodiments, the supply means comprises at least one circulating means, for example the supply means comprises at least one feed roller. Advantageously, the take-off means comprises at least one circulating means, for example the downstream take-off means comprises at least one take-off roller.

Advantageously, at least one first high-speed roller (turning rotor) and at least one second high-speed roller (combing rotor) are arranged between the feed roller and the take-off roller. In some embodiments, at least two feed rollers are advantageously associated with the first high-speed roller. In other embodiments, at least two first high-speed rollers are advantageously present, with which in each case at least one feed roller is associated. Advantageously, a second high-speed roller co-operating with the two first high-speed rollers is present. Advantageously, at least two take-off rollers are associated with the second high-speed roller. In certain embodiments, at least two second high-speed rollers are advantageously present, with which in each case at least one take-off roller is associated. Advantageously, the two second high-speed rollers co-operate with the first high-speed roller. In some embodiments, at least two second high-speed rollers are present, with which a common take-off roller is advantageously associated. In other embodiments, at least two first high-speed rollers and at least two second high-speed rollers are advantageously present, wherein a common take-off roller is associated with the second high-speed rollers and at least one feed roller is associated with each first high-speed roller. Advantageously, a combing device is associated with each second high-speed roller. Advantageously, a combing device is associated with each first high-speed roller. In some embodiments, one sliver-forming device is advantageously arranged downstream of each take-off device, for example downstream of each take-off roller. In other embodiments, one sliver-forming device is advantageously arranged downstream of two take-off devices.

In some embodiments, a rotor combing machine comprises at least two assemblies, in which each assembly comprises, arranged in succession, in each case at least one feed roller, at least one first high-speed roller, at least one second high-speed roller, at least one take-off roller and at least one sliver-forming unit, wherein when using a plurality of sliver-forming units a common sliver-doubling device is arranged downstream. Advantageously, a rotor combing machine having a plurality of combing units (combing rotor and combing means) is present. Advantageously, a rotor combing machine is provided incorporating multiple rotor combing assemblies. Advantageously, the rotor combing machine is a multi-rotor combing machine.

Advantageously, the at least two rotatably mounted rollers that rotate rapidly without interruption comprise at least one turning rotor and at least one combing rotor. Advantageously, the turning rotor and the combing rotor have opposite directions of rotation. Advantageously, for suction of the supplied fibre slivers, at least one suction device is associated with the clamping devices in the region of the transfer of the fibre sliver from the supply device to the first roller and/or in the region of the transfer of the fibre material from the first roller to the second roller.

The invention also provides an apparatus for the fibre-sorting or fibre-selection of a fibre bundle comprising textile fibres, especially for combing, which is supplied by means of supply means to a fibre-sorting device, especially a combing device, in which clamping devices are provided which clamp the fibre bundle at a distance from its free end, and mechanical means are present which generate a combing action from the clamping site to the free end of the fibre sliver, in order to loosen and remove non-clamped constituents, such as, for example, short fibres, neps, dust and the like from the free end, wherein at least one take-off means is provided to remove the combed fibre material, characterised in that that downstream of the supply means there are arranged at least two rotatably mounted rollers rotating rapidly without interruption, which are provided with clamping devices for the fibre bundle, which clamping devices are distributed spaced apart in the region of the rollers' peripheries, and at least two supply means and/or at least one further high-speed roller and/or at least two take-off means are present.

DETAILED DESCRIPTION OF CERTAIN PREFERRED EMBODIMENTS

Figure 1:
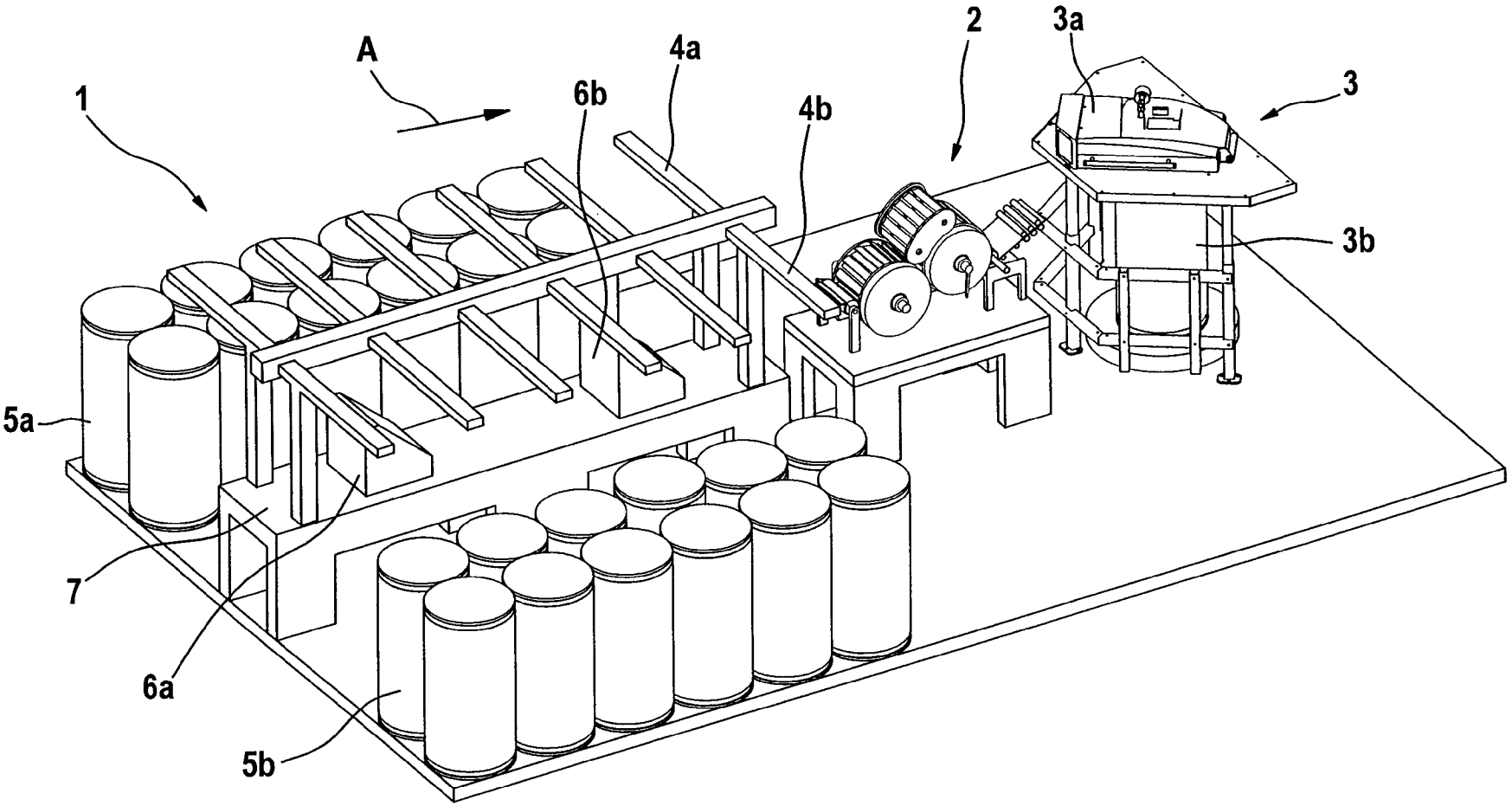
FIG. 1 is a diagrammatic perspective view of a device for combing fibre material, comprising a combing preparation device, a rotor combing machine and a sliver-deposition device.

With reference to FIG. 1, a combing preparation machine 1 has a sliver-fed and lap-delivering spinning room machine and two feed tables 4*a*, 4*b* (creels) arranged parallel to one another, there being arranged below each of the feed tables 4*a*, 4*b* two rows of cans 5*a*, 5*b* containing fibre slivers (not shown). The fibre slivers withdrawn from the cans 5*a*, 5*b* pass, after a change of direction, into two drafting systems 6*a*, 6*b* of the combing preparation machine 1, which are arranged one after the other. From the drafting system 6*a*, the fibre sliver web that has been formed is guided over the web table 7 and, at the outlet of the drafting system 6*b*, laid one over the other and brought together with the fibre sliver web produced therein. By means of the drafting systems 6*a* and 6*b*, in each case a plurality of fibre slivers are combined to form a lap and drafted together. A plurality of drafted laps (two laps in the example shown) are doubled by being placed one on top of the other. The lap so formed is introduced directly into the supply device (feed element) of the downstream rotor combing machine 2. The flow of fibre material is not interrupted. The combed fibre web is delivered at the outlet of the rotor combing machine 2, passes through a funnel, forming a comber sliver, and is deposited in a downstream sliver-deposition device 3. Reference numeral A denotes the operating direction.

An autoleveller drafting system 50 (see FIG. 2) can be arranged between the rotor combing machine 2 and the sliver-deposition device 3. The comber sliver is thereby drafted.

In accordance with a further construction, more than one rotor combing machine 2 is provided. If, for example, two rotor combing machines are present, then the two delivered comber slivers 17 can pass together through the downstream autoleveller drafting system 50 and be deposited as a drafted comber sliver in the sliver-deposition device 3.

The sliver-deposition device 3 comprises a rotating coiler head 3*a*, by which the comber sliver can be deposited in a can 3*b* or (not shown) in the form of a can-less fibre sliver package.

Figure 2:
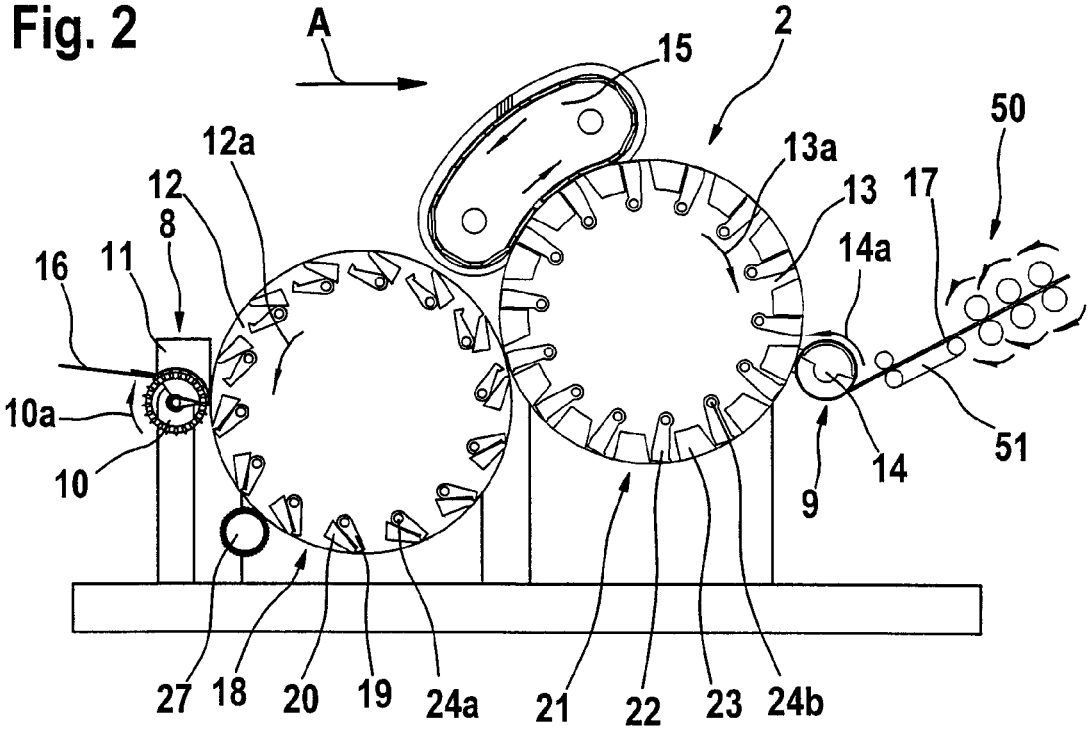
FIG. 2 is a diagrammatic side view of a rotor combing machine according to the invention having two rollers and two combing elements.

FIG. 2 shows a rotor combing machine 2 having a supply device 8 comprising a feed roller 10 and a feed tray 11, having a first roller 12 (turning rotor), second roller 13 (combing rotor), a take-off device 9 comprising a take-off roller 14 and a revolving card top combing assembly 15. The directions of rotation of the rollers 10, 12, 13 and 14 are shown by curved arrows 10*a*, 12*a*, 13*a* and 14*a*, respectively. The incoming fibre lap is indicated by reference numeral 16 and the delivered fibre web is indicated by reference numeral 17. The rollers 10, 12, 13 and 14 are arranged one after the other. Arrow A denotes the operating direction.

The first roller 12 is provided in the region of its outer periphery with a plurality of first clamping devices 18 which extend across the width of the roller 12 (see FIG. 3) and each consist of an upper nipper 19 (gripping element) and a lower nipper 20 (counter-element). In its one end region facing the centre point or the pivot axis of the roller 12, each upper nipper 19 is rotatably mounted on a pivot bearing 24*a*, which is attached to the roller 12. The lower nipper 20 is mounted on the roller 12 so as to be either fixed or movable. The free end of the upper nipper 19 faces the periphery of the roller 12. The upper nipper 19 and the lower nipper 20 co-operate so that they are able to grip a fibre bundle 16 (clamping) and release it. A combing roller 27 is associated as combing device with the first roller 12.

The second roller 13 is provided in the region of its outer periphery with a plurality of two-part clamping devices 21, which extend across the width of the roller 13 (see FIG. 3) and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is mounted on the roller 13 so as to be either fixed or movable. The free end of the upper nipper 22 faces the periphery of the roller 13. The upper nipper 22 and the lower nipper 23 co-operate so that they are able to grip a fibre bundle (clamping) and release it. In the case of roller 12, around the roller periphery between the feed roller 10 and the second roller 13 the clamping devices 18 are closed (they clamp fibre bundles (not shown) at one end) and between the second roller 13 and the feed roller 10 the clamping devices 18 are open. In roller 13, around the roller periphery between the first roller 12 and the doffer 14 the clamping devices 21 are closed (they clamp fibre bundles (not shown) at one end) and between the doffer 14 and the first roller 12 the clamping devices 21 are open. Reference numeral 50 denotes a drafting system, for example an autoleveller drafting system. The drafting system 50 is advantageously arranged above the coiler head 3*a*. Reference numeral 51 denotes a driven ascending conveyor, for example a conveyor belt. It is also possible to use an upwardly inclined metal sheet or the like for conveying purposes.

Figure 3:
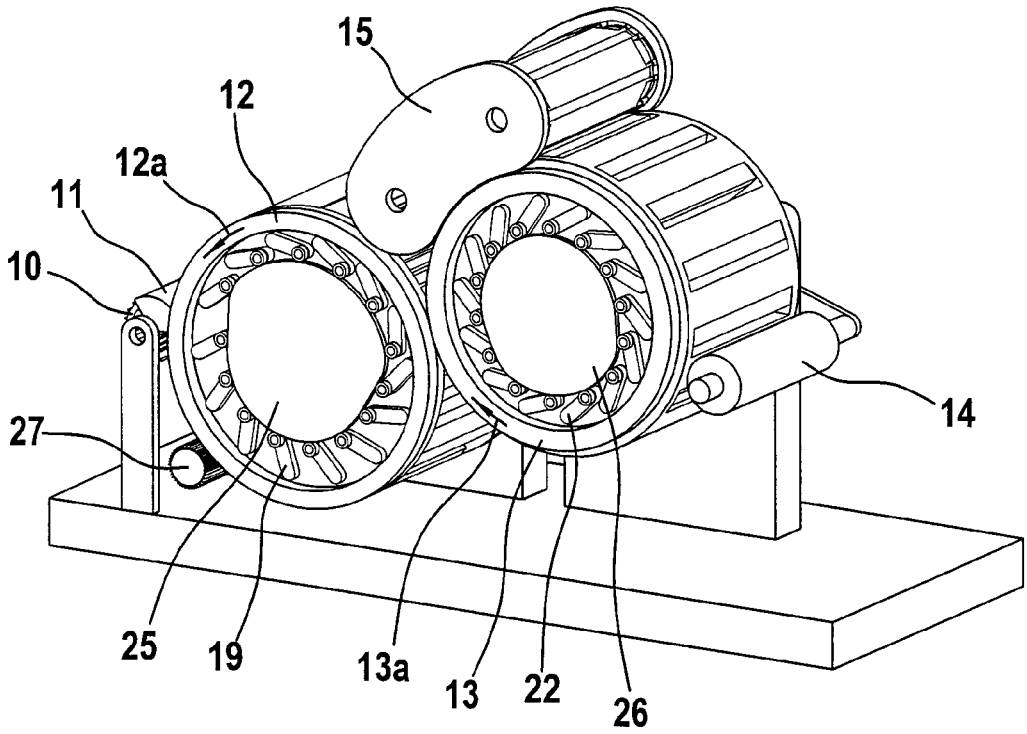
FIG. 3 is a perspective view of a rotor combing machine constructed generally as shown in FIG. 2 and further having two cam discs.

In the embodiment of FIG. 3, two fixed cam discs 25 and 26 are provided, about which the roller 12 having the first clamping devices 18 and the roller 13 having the second clamping devices 21 are rotated in the direction of arrows 12*a* and 13*a*, respectively. The loaded upper nippers 19 and 22 are arranged in the intermediate space between the outer periphery of the cam discs 25, 26 and the inner cylindrical surfaces of the rollers 12, 13. By rotation of the rollers 12 and 13 about the cam discs 25 and 26 respectively, the upper nippers 19 and 22 are rotated about pivot axes 24*a* and 24*b*, respectively. In that way, the opening and closing of the first clamping devices 18 and the second clamping devices 21 is implemented.

Figure 4:
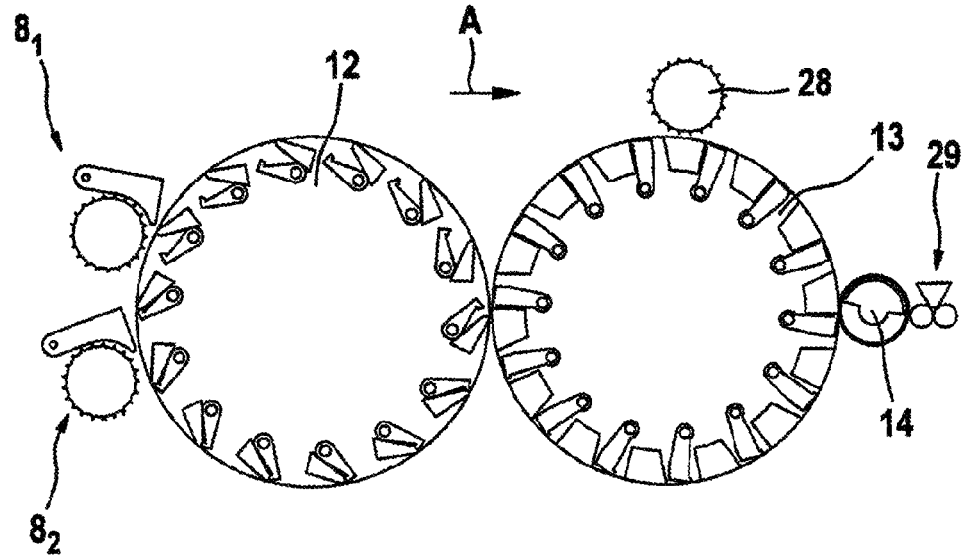
FIG. 4 shows an embodiment of the invention in which a rotor combing machine has two feed devices and one turning rotor, one combing rotor, one combing device, one take-off unit and one sliver-forming unit.

In the embodiment of FIG. 4, an embodiment of a rotor combing machine is provided with two feed devices $\mathbf{8}_1$, $\mathbf{8}_2$ and one turning rotor 12, one combing rotor 13, one combing device 28, one take-off unit 14 and one sliver-forming unit 29 is provided.

Figure 5:
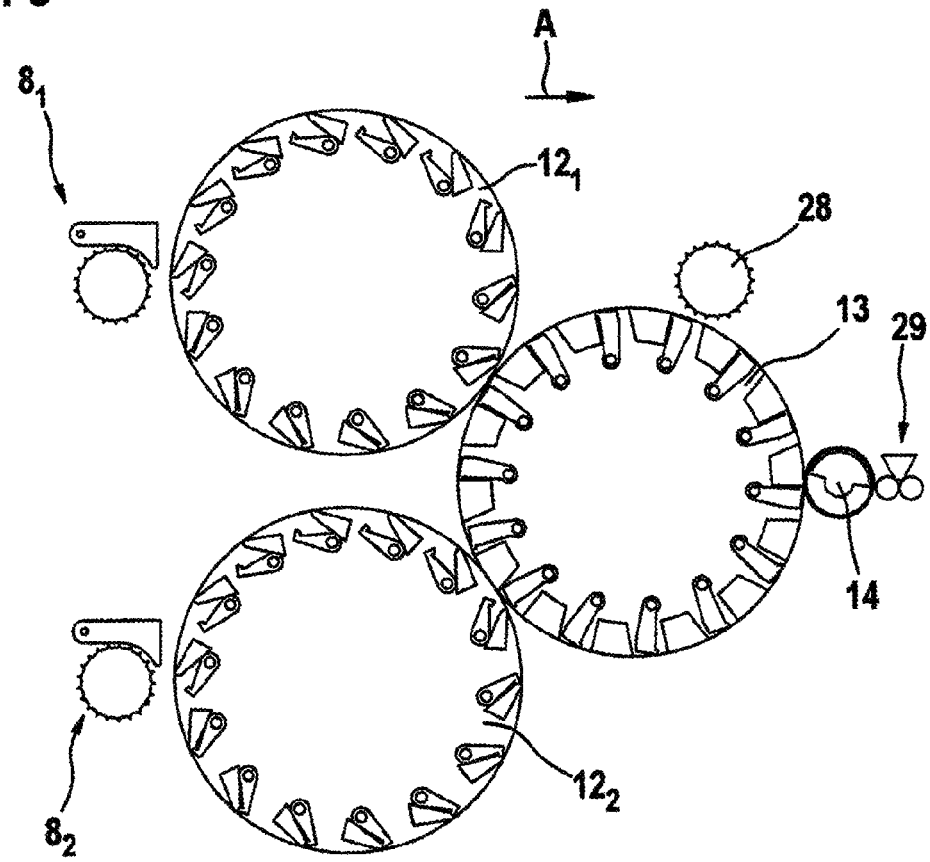
FIG. 5 shows an embodiment of the invention in which a rotor combing machine has two turning rotors and one feed device per turning rotor, and one combing rotor, one combing device, one take-off unit and one sliver-forming unit.

In the embodiment shown in FIG. 5, a rotor combing machine is provided with two turning rotors $\mathbf{12}_1$, $\mathbf{12}_2$, and one feed device $\mathbf{8}_1$, $\mathbf{8}_2$ per turning rotor $\mathbf{12}_1$, $\mathbf{12}_2$ and one combing rotor 13, one combing device 28, one take-off unit 14 and one sliver-forming unit 29.

Figure 6:
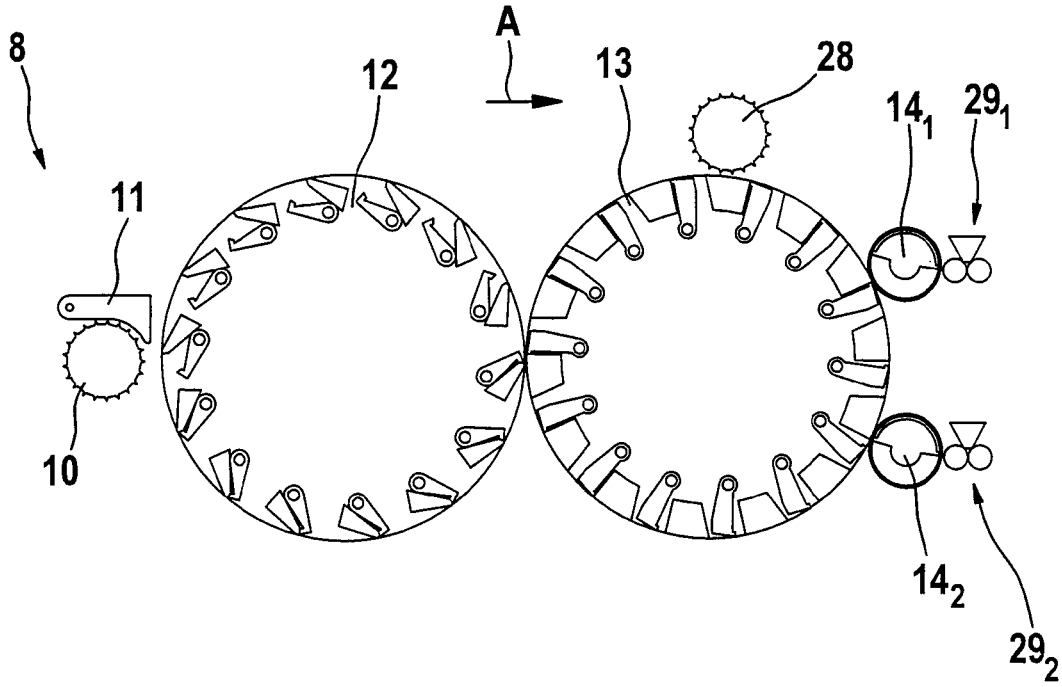
FIG. 6 shows an embodiment of the invention in which a rotor combing machine has two take-off devices per combing rotor when using one combing rotor, one sliver-forming unit per take-off device, one combing device, one turning rotor and one feed unit.

In the embodiment of FIG. 6, a rotor combing machine is provided with two take-off units $\mathbf{14}_1$, $\mathbf{14}_2$ per combing rotor when using one combing rotor 13, one sliver-forming unit $\mathbf{29}_1$, $\mathbf{29}_2$ per take-off unit $\mathbf{14}_1$, $\mathbf{14}_2$, one combing device 28, one turning rotor 12 and one feed unit 8 is provided.

Figure 7:
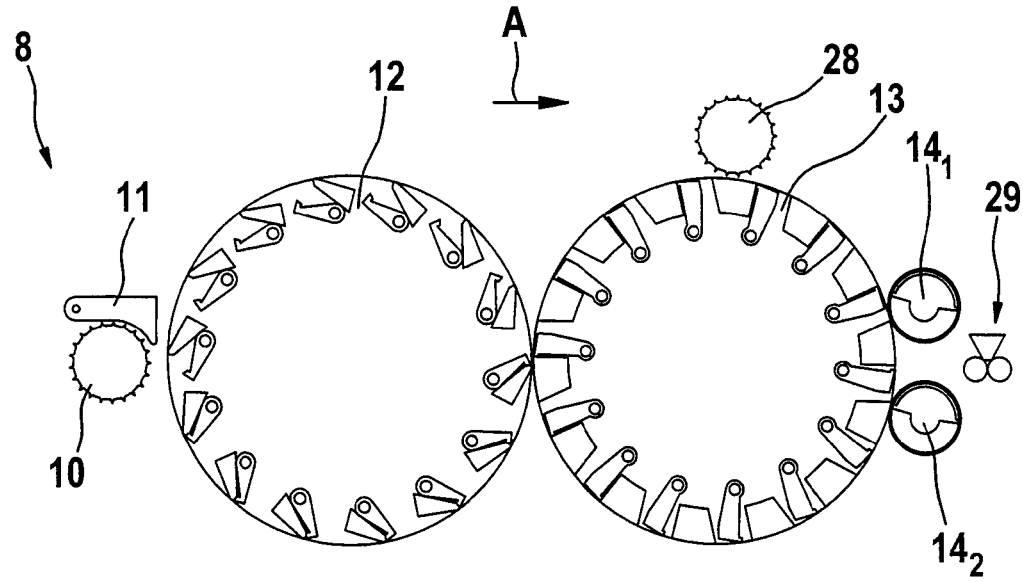
FIG. 7 shows a embodiment of the invention in which a rotor combing machine has two take-off devices per combing rotor when using one combing rotor, one sliver-forming unit for the two take-off devices, one combing device, one turning rotor and one feed unit.

In the embodiment of FIG. 7, a rotor combing machine is provided with two take-off units $\mathbf{14}_1$, $\mathbf{14}_2$ per combing rotor when using one combing rotor 13, one sliver-forming unit 29 for the two take-off units $\mathbf{14}_1$, $\mathbf{14}_2$, one combing device 28, one turning rotor 12 and one feed unit 8.

Figure 8:
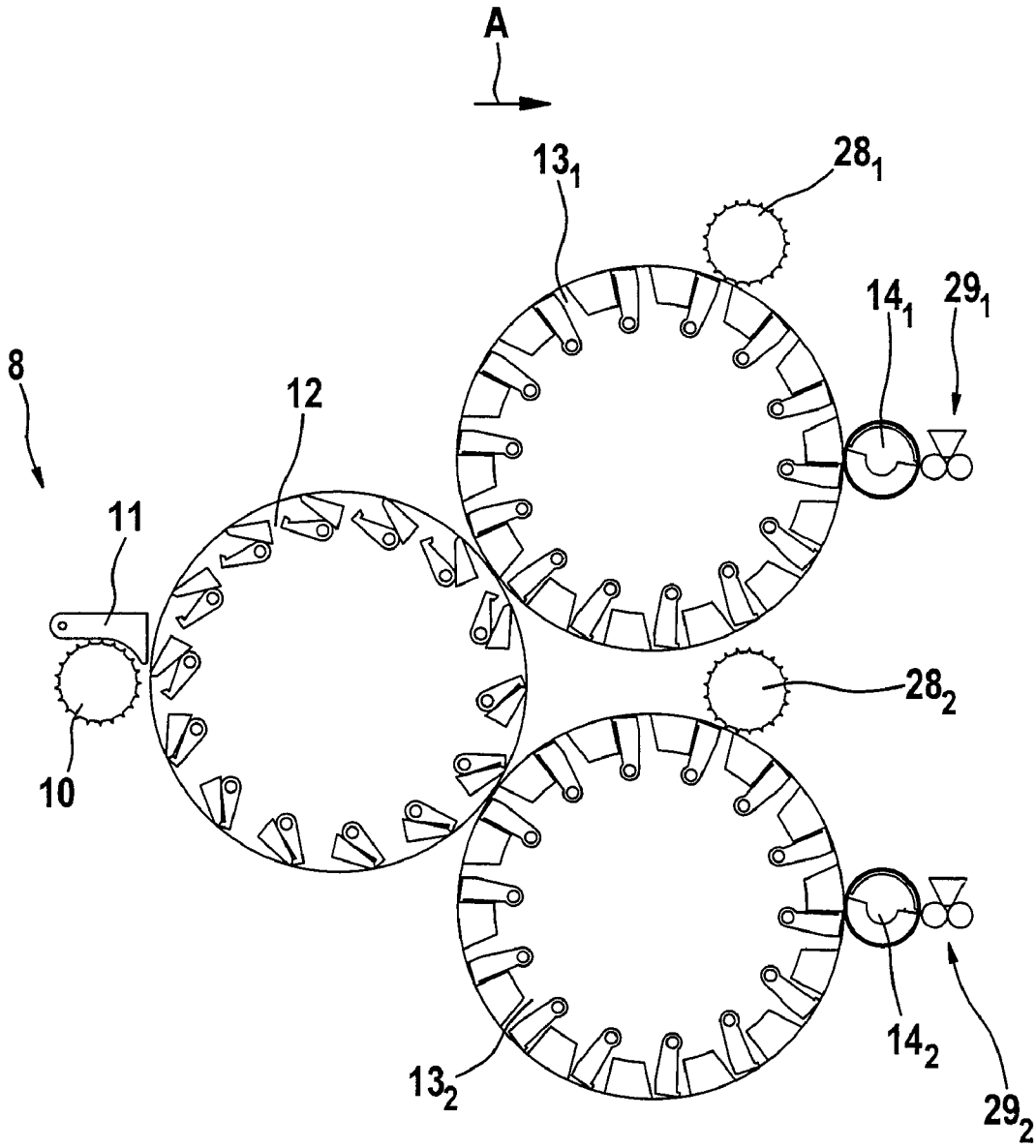
FIG. 8 shows an embodiment of the invention in which a rotor combing machine has two combing rotors, with one combing device and one take-off device per combing rotor, and one sliver-forming unit per take-off device, when using one turning rotor with one feed unit.

In the embodiment of FIG. 8, a rotor combing machine is provided with two combing rotors $\mathbf{13}_1$, $\mathbf{13}_2$, with one combing device $\mathbf{28}_1$, $\mathbf{28}_2$ and one take-off device $\mathbf{14}_1$, $\mathbf{14}_2$ per combing rotor $\mathbf{13}_1$, $\mathbf{13}_2$, and one sliver-forming unit $\mathbf{29}_1$, $\mathbf{29}_2$ per take-off unit $\mathbf{14}_1$, $\mathbf{14}_2$, when using one turning rotor 12 with one feed unit 8.

Figure 9:
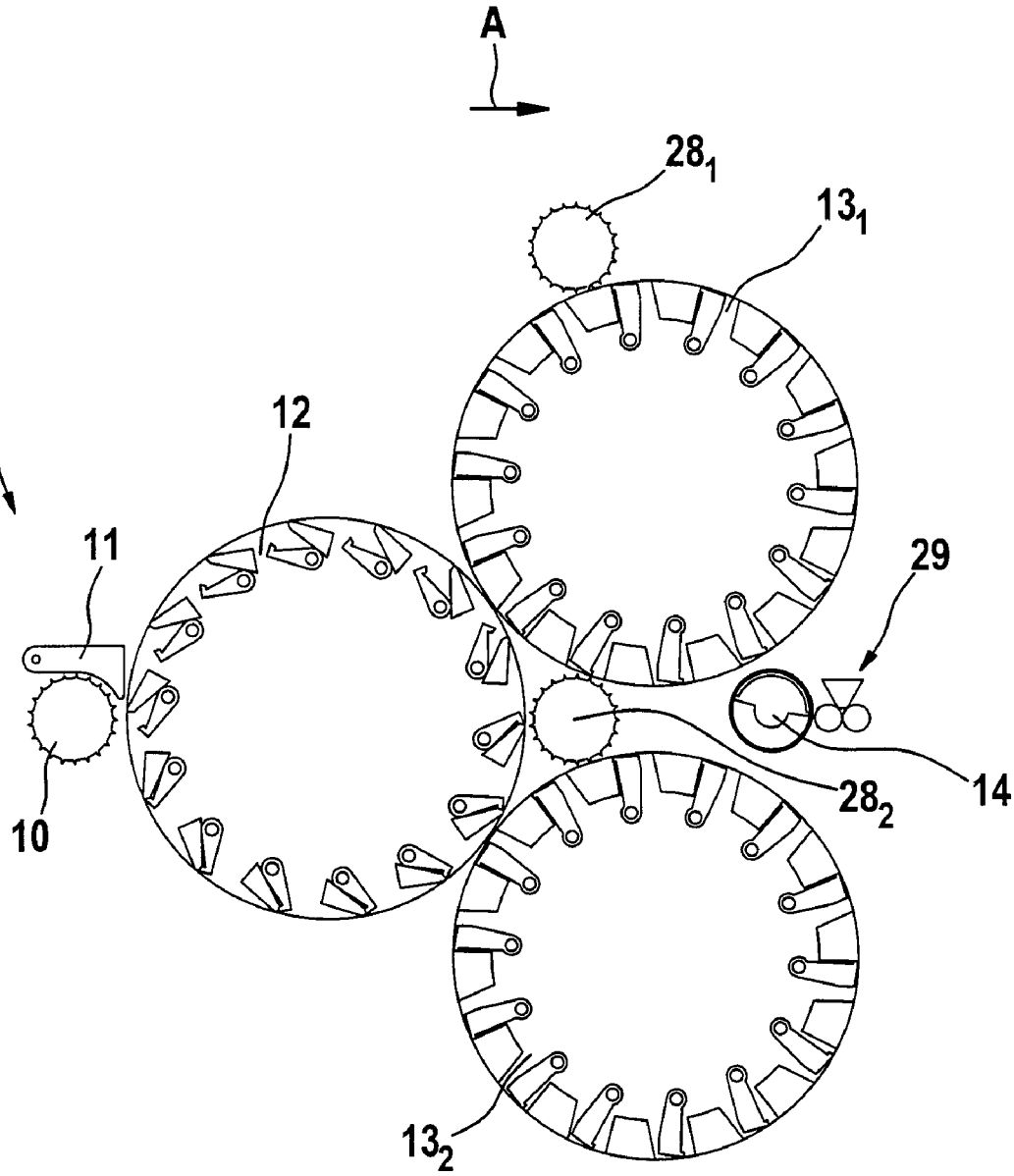
FIG. 9 shows an embodiment of the invention in which a rotor combing machine has two combing rotors with one combing device each and one take-off device for the two combing rotors, when using one turning rotor, one feed unit and one sliver-forming unit.

In the embodiment of FIG. 9, a rotor combing machine is provided with two combing rotors $\mathbf{13}_1$, $\mathbf{13}_2$, each having a combing device $\mathbf{28}_1$, $\mathbf{28}_2$, and with one take-off device 14 for the two combing rotors $\mathbf{13}_1$, $\mathbf{13}_2$, when using one turning rotor 12, one feed unit 8, and one sliver-forming unit 29.

Figure 10:
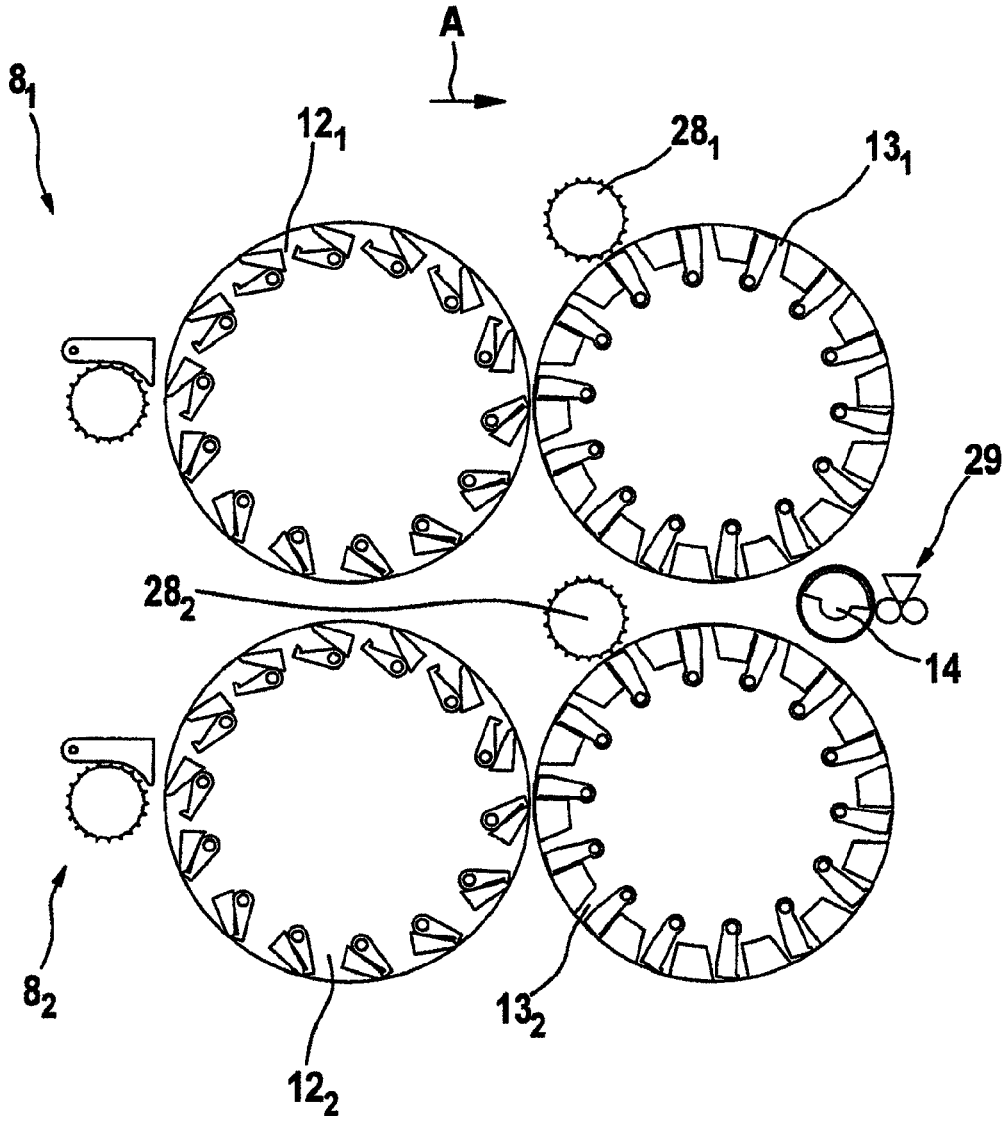
FIG. 10 shows an embodiment of the invention in which a rotor combing machine has two turning rotors and two combing rotors, the latter with a combing device each, and one take-off device for the two combing rotors when using one sliver-forming unit, and one feed unit per turning rotor.

In the embodiment of FIG. 10, a rotor combing machine is provided with two turning rotors $\mathbf{12}_1$, $\mathbf{12}_2$ and two combing rotors $\mathbf{13}_1$, $\mathbf{13}_2$, the latter each having a combing device $\mathbf{28}_1$, $\mathbf{28}_2$, and one take-off device 14 for the two combing rotors $\mathbf{13}_1$, $\mathbf{13}_2$ when using one sliver-forming device 29, and one feed unit $\mathbf{8}_1$, $\mathbf{8}_2$ per turning rotor $\mathbf{12}_1$, $\mathbf{12}_2$.

Figure 11:
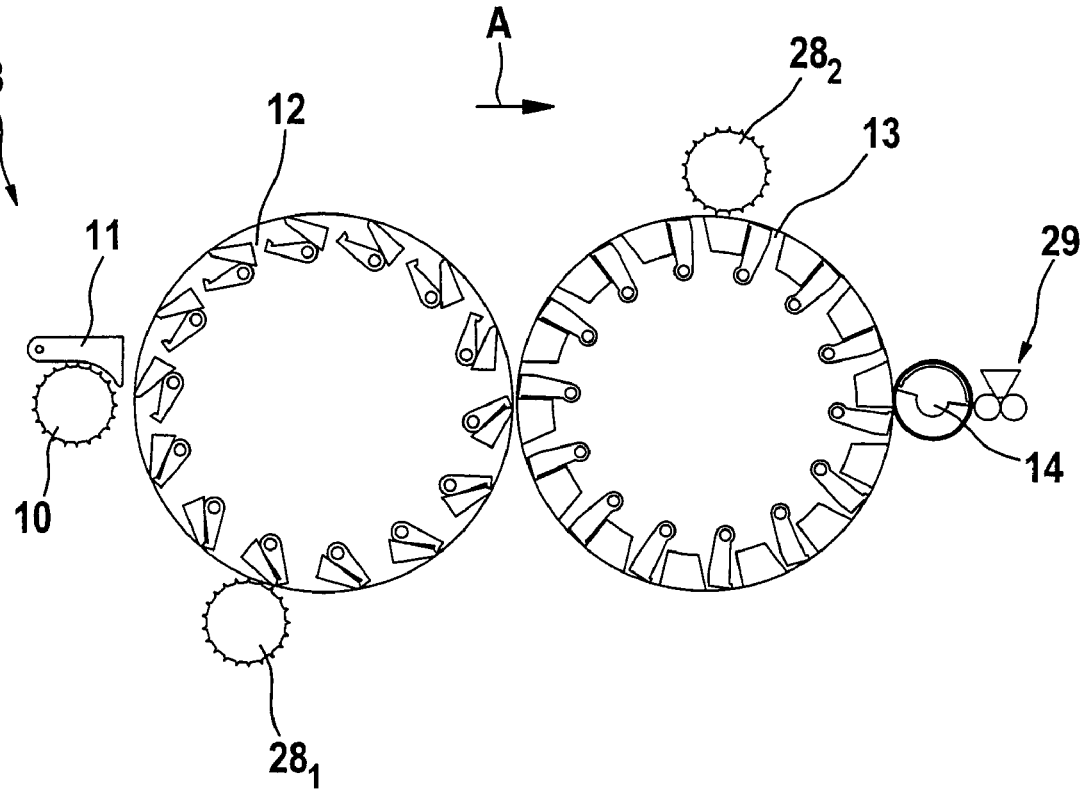
FIG. 11 shows an embodiment of the invention in which a rotor combing machine has one combing device on the turning rotor, when using one feed unit, one turning rotor, one combing rotor with combing device, one take-off device and one sliver-forming unit.

In the embodiment of FIG. 11, a rotor combing machine is provided with a combing device $\mathbf{28}_1$ on the turning rotor 12, with use of one feed unit 8, one turning rotor 12, one combing rotor 13 with combing device $\mathbf{28}_2$, one take-off device 14 and one sliver-forming unit 29 is provided.

Figure 12:
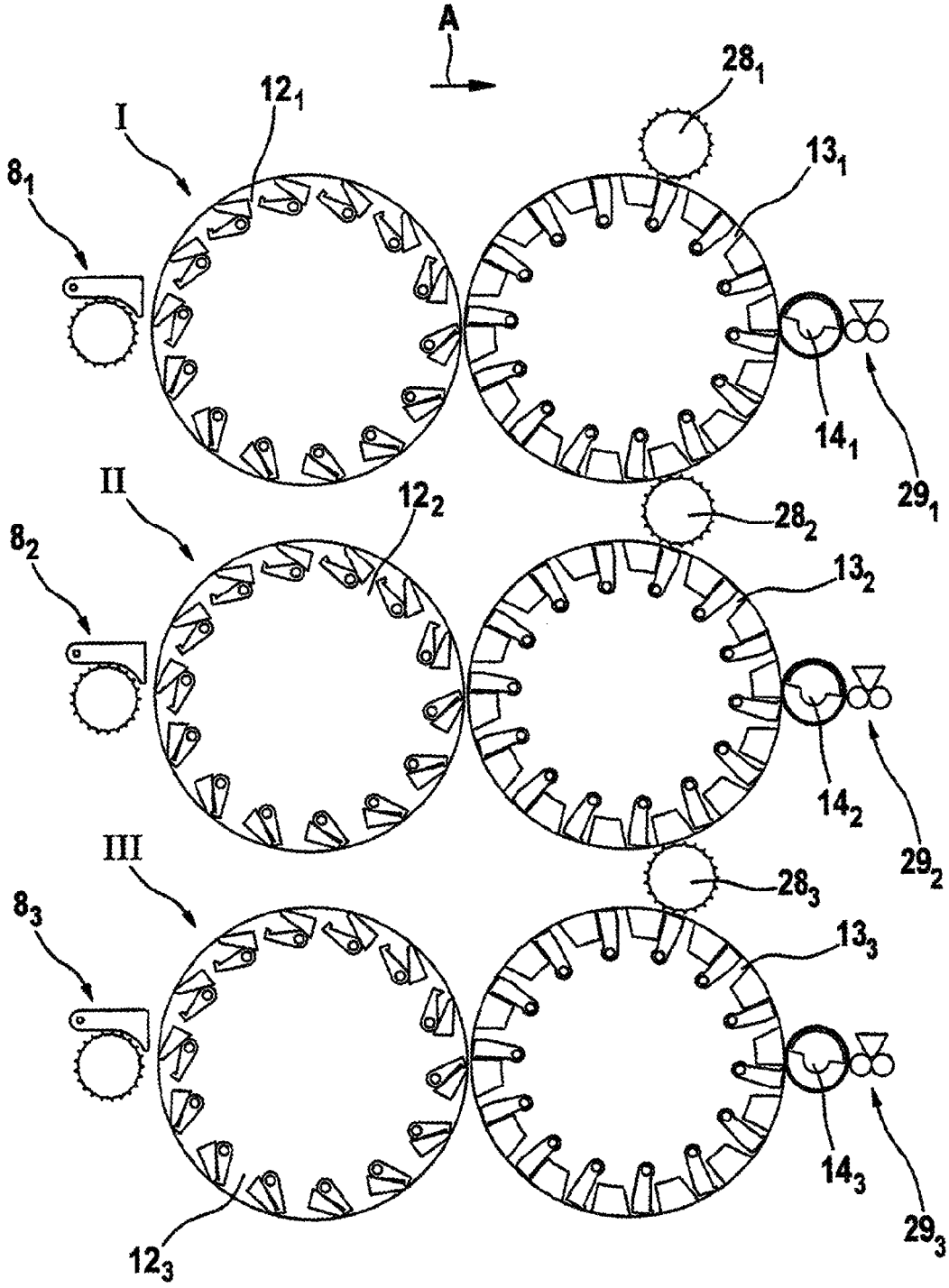
FIG. 12 shows an embodiment of the invention in which a rotor combing machine comprises three assemblies I, II, III with subsequent sliver doubling.

FIG. 12 shows a further embodiment of the invention in the form of a rotor combing machine comprising three assemblies I, II, III. The assemblies I, II, III each have a feed unit $\mathbf{8}_1$, $\mathbf{8}_2$, $\mathbf{8}_3$, respectively, a turning rotor $\mathbf{12}_1$, $\mathbf{12}_2$, $\mathbf{12}_3$, respectively, a combing rotor $\mathbf{13}_1$, $\mathbf{13}_2$, $\mathbf{13}_3$, respectively, each with a combing device $\mathbf{28}_1$, $\mathbf{28}_2$, $\mathbf{28}_3$, respectively, a take-off unit $\mathbf{14}_1$, $\mathbf{14}_2$, $\mathbf{14}_3$, respectively, and sliver-forming units $\mathbf{29}_1$, $\mathbf{29}_2$, $\mathbf{29}_3$, respectively. A sliver doubling takes place downstream after the sliver-forming units $\mathbf{29}_1$, $\mathbf{29}_2$, $\mathbf{29}_3$. In that process, the three fibre slivers formed (not shown) are collectively supplied to further processing facility, for example, a drafting system 50 (see FIG. 2). The assemblies I, II, III correspond substantially to the construction illustrated in FIG. 3 (without combing roller 27).

Figure 13:
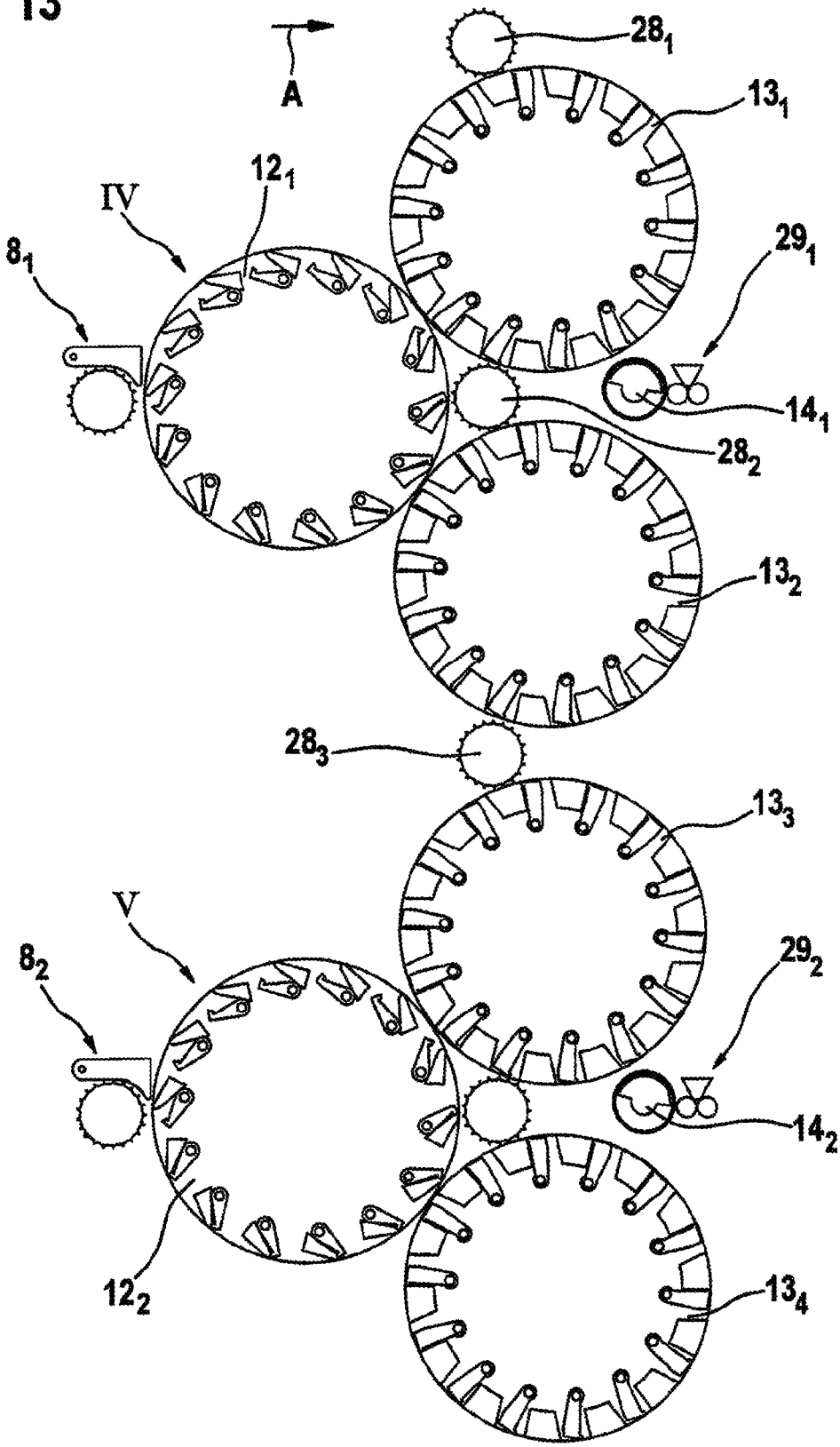
FIG. 13 shows an embodiment of the invention in which a rotor combing machine comprises two assemblies IV, V and subsequent sliver doubling.

FIG. 13 shows an embodiment of the invention in the form of a rotor combing machine comprising two assemblies IV, V. The assemblies IV, V each correspond substantially to the construction illustrated in FIG. 9. A sliver doubling (not shown) takes place downstream of the sliver-forming units $\mathbf{29}_1$, $\mathbf{29}_2$. In the embodiment of FIG. 13 there is used a feed device $\mathbf{8}_1$, $\mathbf{8}_2$ for each turning rotor $\mathbf{12}_1$, $\mathbf{12}_2$ and, further, two combing rotors $\mathbf{13}_1$, $\mathbf{13}_2$ and $\mathbf{13}_3$, $\mathbf{13}_4$, with one combing device and one take-off device $\mathbf{14}_1$, $\mathbf{14}_2$ and one sliver-forming unit $\mathbf{29}_1$, $\mathbf{29}_2$ at each assembly.

The assemblies I, II, III (FIG. 12) and IV, V (FIG. 13) illustrated in FIGS. 12 and 13 in each case co-operate. The assemblies I, II, III and IV, V can be arranged in a common machine frame (not shown) and preferably be connected to a common machine control and regulation device (not shown).

Figure 14:
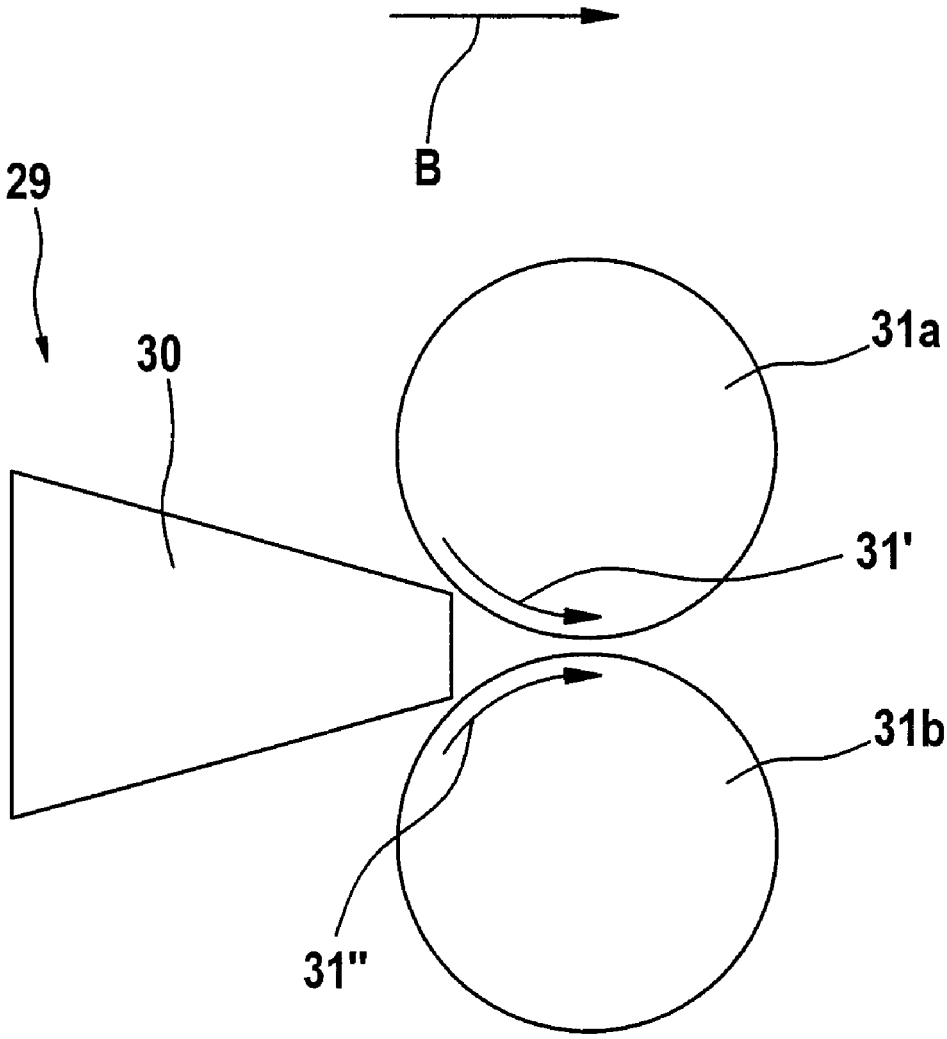
FIG. 14 is a diagrammatic side view of a sliver-forming unit with sliver funnel and take-off rollers.

FIG. 14 shows one suitable form of sliver-forming unit to use in an apparatus according to the invention. The sliver-forming unit 29 comprises a sliver funnel 30, downstream of which in the sliver running direction B are arranged two co-operating take-off rollers 31*a*, 31*b* (calender rollers). The take-off rollers 31*a*, 31*b* rotate in the direction of the curved arrows 31', 31" in opposite directions.

Using the rotor combing machine according to the invention, more than 2000 nips/min, for example from 3000 to 5000 nips/min, are achieved.

Figure 15:
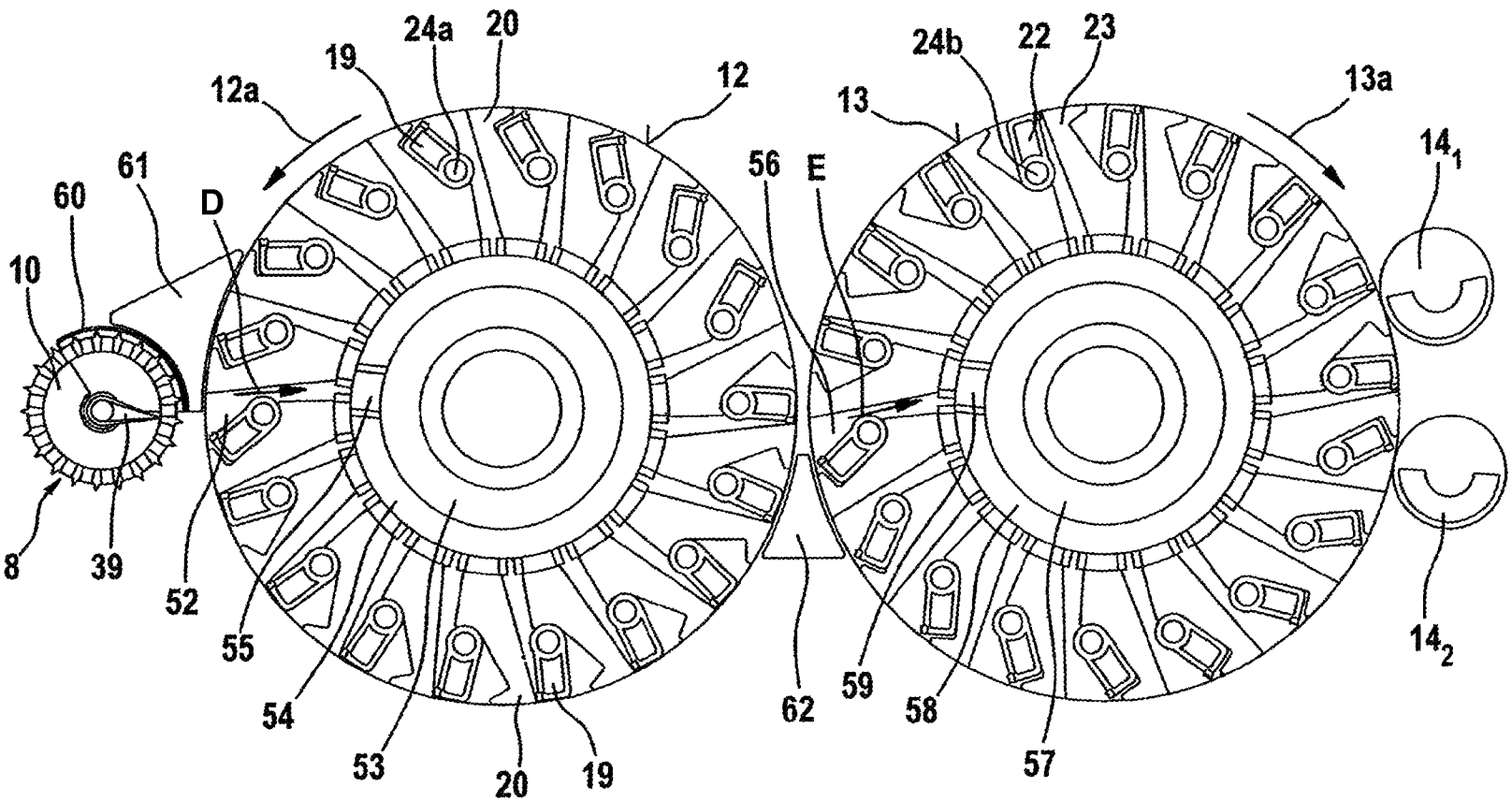
FIG. 15 shows a further embodiment of a rotor combing machine according to the invention in which suction devices are associated with the clamping devices.

In the embodiment of FIG. 15, the rotatably mounted rollers 12 and 13 with clamping devices 19, 20 and 22, 23 respectively are additionally fitted with suction channels 52 and 56 respectively (suction openings) which, in the region of the delivery between the supply device 8 and the roller 12 and in the region of the delivery between the rollers 12 and 13, influence the alignment and movement of the fibres being transported. In that way, the time for the taking up of the fibre material from the supply device 8 onto the first roller 12 and the delivery to the second roller 13 is significantly reduced, so that the nip rate can be increased. The suction openings 52, 56 are arranged within the rollers 12 and 13, respectively, and rotate with the rollers. At least one suction opening is associated with each clamping device 19, 20 and 22, 23 (nipper device). The suction openings 52, 56 are each arranged between a gripping element (upper nipper) and counter-element (lower nipper). In the interior of the rotors 12, 13 there is an underpressure region 53 to 55 and 57 to 59, respectively, created by the suction flow at the suction openings 52, 56. The reduced pressure can be generated by connecting to a flow-generating machine. The suction flow at the individual suction openings 52, 56 can be switched between reduced pressure region and suction opening so that it is applied only at particular adjustable angular positions on the roller circumference. For the purpose of the switching, valves or a valve pipe 54, 58 with openings 55 and 59, respectively, in the corresponding angular positions can be used. The release of the suction flow may also be brought about by the movement of the gripping element (upper nipper). Furthermore, it is possible to arrange a region of reduced pressure only at the corresponding angular positions.

Additionally, a flow of blown air can be provided in the region of the supply device 8 and/or in the region of transfer between the rollers. The source of the flow of blown air (blowing nozzle 39) is arranged inside the feed roller 10 and has effect, through the air-permeable surface of the supply device or air passage openings, towards the outside in the direction of the first roller. Also, in the region of the supply device 8, the element for producing the blown air current can be fixedly arranged, directly under or over the supply device 8. In the region of the transfer between the rollers 12, 13 the blown air current sources can be arranged at the rotor perimeter of the first roller 12, directly under or over each nipper device. For the blown air generation there may be used compressed air nozzles or air blades.

The suction flow D, E can favourably influence and shorten not only the guiding, but also the separation process between the lap and the tufts to be removed in the region of the supply device 8.

As a result of the provision of additional air guide elements 60 and lateral screens 61, 62 the direction of the flow can be influenced and the air carried round with the rotors separated off. In that way, the time for alignment can be further shortened. In particular, a screen element between the first rotor 12 and supply device 8 over the lap and a screen element on each side of the roller have proved useful.

The combed-out fibre portion passes from the second roller 13 onto the piecing rollers $\mathbf{14}_1$ and $\mathbf{14}_2$ In use of the rotor combing machine according to the invention there is achieved a mechanical combing of the fibre material to be combed out, that is, mechanical means are used for the combing. There is no pneumatic combing of the fibre material to be combed, that is, no air currents, e.g. suction and/or blown air currents, are used for combing.

In the rotor combing machine according to the invention there are present rollers that rotate rapidly without interruption and that have clamping devices. Rollers that rotate with interruptions, stepwise or alternating between a stationary and a rotating state are not used.

Although the foregoing invention has been described in detail by way of illustration and example, for purposes of understanding, it will be obvious that changes and modification may be practiced within the scope of the appended claims.

What we claim is:

1. An apparatus for the fibre-sorting or fibre-selection of a fibre bundle comprising textile fibres, the apparatus comprising:

at least one fibre sorting device comprising at least two first high-speed rollers and a second high-speed roller that rotate rapidly without interruption during use;

clamping devices distributed about the periphery of the first rollers and the second roller, each clamping device adapted to clamp a bundle of the textile fibres at a clamping site located at a distance from a free end of the fibre bundle;

at least one supply device adapted to supply the fibre bundle to the fibre-sorting device, the supply device comprising a feed roller associated with each of the at least two first high speed rollers;

at least one take-off device adapted to remove the sorted fibre material from the fibre-sorting device; and at least one mechanical combing device adapted to comb the fibre bundle from the clamping site to the free end in order to loosen and remove non-clamped constituents.

2. An apparatus according to claim 1, wherein the take-off device comprises at least one take-off roller.

3. An apparatus according to claim 1, wherein the at least two first high-speed rollers and the at least one second high-speed roller are arranged between at least one feed roller and at least one take-off device.

4. An apparatus according to claim 1, wherein the one second high-speed roller co-operates with the at least two first high-speed rollers.

5. An apparatus according to claim 4, wherein at least two take-off rollers are associated with the second high-speed roller.

6. An apparatus for the fibre-sorting or fibre-selection of a fibre bundle comprising textile fibres, the apparatus comprising:

at least one fibre sorting device comprising at least a first high-speed roller and at least two second high-speed rollers that rotate rapidly without interruption during use;

clamping devices distributed about the periphery of the first roller and the second rollers, each clamping device adapted to clamp a bundle of the textile fibres at a clamping site located at a distance from a free end of the fibre bundle;

at least one supply device adapted to supply the fibre bundle to the fibre-sorting device;

at least one take-off device adapted to remove the sorted fibre material from the fibre-sorting device, the take-off device comprising a take-off roller associated with each of the at least two second high-speed rollers;

at least one mechanical combing device adapted to comb the fibre bundle from the clamping site to the free end in order to loosen and remove non-clamped constituents.

7. An apparatus according to claim 6, wherein the at least two second high-speed rollers co-operate with the first high-speed roller.

8. An apparatus for the fibre-sorting or fibre-selection of a fibre bundle comprising textile fibres, the apparatus comprising:

at least one fibre sorting device comprising at least two first high-speed rollers and at least two second high-speed rollers that rotate rapidly without interruption during use;

clamping devices distributed about the periphery of the first rollers and the second rollers, each clamping device adapted to clamp a bundle of the textile fibres at a clamping site located at a distance from a free end of the fibre bundle;

at least one supply device adapted to supply the fibre bundle to the fibre-sorting device, the supply device comprising a feed roller associated with each of the at least two first high speed rollers;

at least one take-off device adapted to remove the sorted fibre material from the fibre-sorting device, the take-off device comprising a common take-off roller associated with the at least two second high-speed rollers; and at least one mechanical combing device adapted to comb the fibre bundle from the clamping site to the free end in order to loosen and remove non-clamped constituents.

9. An apparatus according to claim 1, wherein the combing device is associated with the second high-speed roller.

10. An apparatus according to claim 1, wherein the combing device is associated with each of the at least two first high-speed rollers.

11. An apparatus according to claim 1, further comprising a sliver-forming device arranged downstream of the take-off device.

12. An apparatus for the fibre-sorting or fibre-selection of a fibre bundle comprising textile fibres, the apparatus comprising:

at least one fibre sorting device comprising at least a first high-speed roller and at least a second high-speed roller that rotate rapidly without interruption during use;

clamping devices distributed about the periphery of the first roller and the second roller, each clamping device adapted to clamp a bundle of the textile fibres at a clamping site located at a distance from a free end of the fibre bundle;

at least one supply device adapted to supply the fibre bundle to the fibre-sorting device;

at least two take-off devices adapted to remove the sorted fibre material from the fibre-sorting device;

at least one mechanical combing device adapted to comb the fibre bundle from the clamping site to the free end in order to loosen and remove non-clamped constituents; and a sliver-forming device arranged downstream of the at least two take-off devices.

13. A rotor combing machine comprising at least two of the apparatuses of claim 1, a sliver-forming unit associated with each of the at least two apparatuses, and a common sliver-doubling device arranged downstream of the sliver forming units.

14. A rotor combing machine comprising the apparatus of claim 1, and a plurality of combing units, each combing unit comprising a combing rotor and a cooperating combing device.

15. A rotor combing machine comprising the apparatus of claim 1, and multiple rotor combing assemblies.

16. An apparatus according to claim 1, wherein the at least two first high-speed rollers are turning rotors and the second high-speed roller is a combing rotor.

17. An apparatus according to claim 16, wherein the turning rotor and the combing rotor have opposite directions of rotation.

18. An apparatus for the fibre-sorting or fibre-selection of a fibre bundle comprising textile fibres, the apparatus comprising:

at least one fibre sorting device comprising at least a first high-speed roller and at least a second high-speed roller that rotate rapidly without interruption during use;

clamping devices distributed about the periphery of the first roller and the second roller, each clamping device adapted to clamp a bundle of the textile fibres at a clamping site located at a distance from a free end of the fibre bundle;

at least one supply device adapted to supply the fibre bundle to the fibre-sorting device;

at least one take-off device adapted to remove the sorted fibre material from the fibre-sorting device;

at least one mechanical combing device adapted to comb the fibre bundle from the clamping site to the free end in order to loosen and remove non-clamped constituents; and at least one element that generates a blown air current associated with the clamping devices in a transfer region between the supply device and the first high-speed roller and/or in a transfer region between the first high-speed roller and the second high-speed roller.

* * * * *